United States Patent [19]

Ferro

[11] Patent Number: 4,945,587

[45] Date of Patent: Aug. 7, 1990

[54] BEACH CHAIR WITH ADJUSTABLE BACK HAVING AN AIR MATTRESS ATTACHED THERETO

[76] Inventor: Robert M. Ferro, 821 Kinau St., No.C5, Honolulu, Hi. 96813

[21] Appl. No.: 468,256

[22] Filed: Jan. 22, 1990

[51] Int. Cl.[5] ..... A47C 27/08

[52] U.S. Cl. ..... 5/419; 5/420; 297/377

[58] Field of Search ..... 5/417–420, 5/433, 449; 297/377, DIG. 3

[56] References Cited

U.S. PATENT DOCUMENTS

| | | | |
|---|---|---|---|
| D. 116,558 | 9/1939 | Ficks | 5/419 |
| 2,304,700 | 12/1942 | Manville | 5/419 |
| 2,946,067 | 7/1960 | Wolshin | 5/418 |
| 3,293,669 | 12/1966 | Emery | 297/377 |
| 3,441,314 | 4/1969 | Duffield | 297/377 |
| 3,808,616 | 5/1974 | White | 5/419 |
| 4,375,901 | 3/1983 | MacDonald | 297/377 |

FOREIGN PATENT DOCUMENTS

| | | | |
|---|---|---|---|
| 1141744 | 9/1957 | France | 5/420 |

*Primary Examiner*—Alexander Grosz
*Attorney, Agent, or Firm*—Michael I. Kroll

[57] ABSTRACT

An air chair is provided and consists of a rectangular shaped air mattress secured to an adjustable backrest so that the adjustable backrest may be positioned upon beach sand to adjust the air mattress in various reclined positions in which a person may sit upon the air mattress and lean comfortably against the portion of the air mattress on the backrest.

5 Claims, 2 Drawing Sheets

BEACH CHAIR WITH ADJUSTABLE BACK HAVING AN AIR MATTRESS ATTACHED THERETO

BACKGROUND OF THE INVENTION

1. Field of the Invention

The instant invention relates generally to outdoor furniture and more specifically it relates to an air chair.

2. Description of the Prior Art

Numerous outdoor furniture have been provided in prior art that are adapted to include chairs fabricated out of durable materials to withstand the elements of all types of weather. While these units may be suitable for the particular purpose to which they address, they would not be as suitable for the purposes of the present invention as heretofore described.

SUMMARY OF THE INVENTION

A primary object of the present invention is to provide an air chair that will overcome the shortcomings of the prior art devices.

Another object is to provide an air chair that combines the best features of a beach chair and an air mattress together so that a person can sit upon the air chair in comfort on the beach.

An additional object is to provide an air chair that includes an adjustable backrest frame in which the air mattress can be folded thereon and carried when not being used.

A further object is to provide an air chair that is simple and easy to use.

A still further object is to provide an air chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specfic construction illustrated and described within the scope of the appended claims.

BRIEF DESCRIPTION OF THE DRAWING FIGURES

DETAILED DESCRIPTION OF THE PREFERRED EMBODIMENTS

Figure 1:
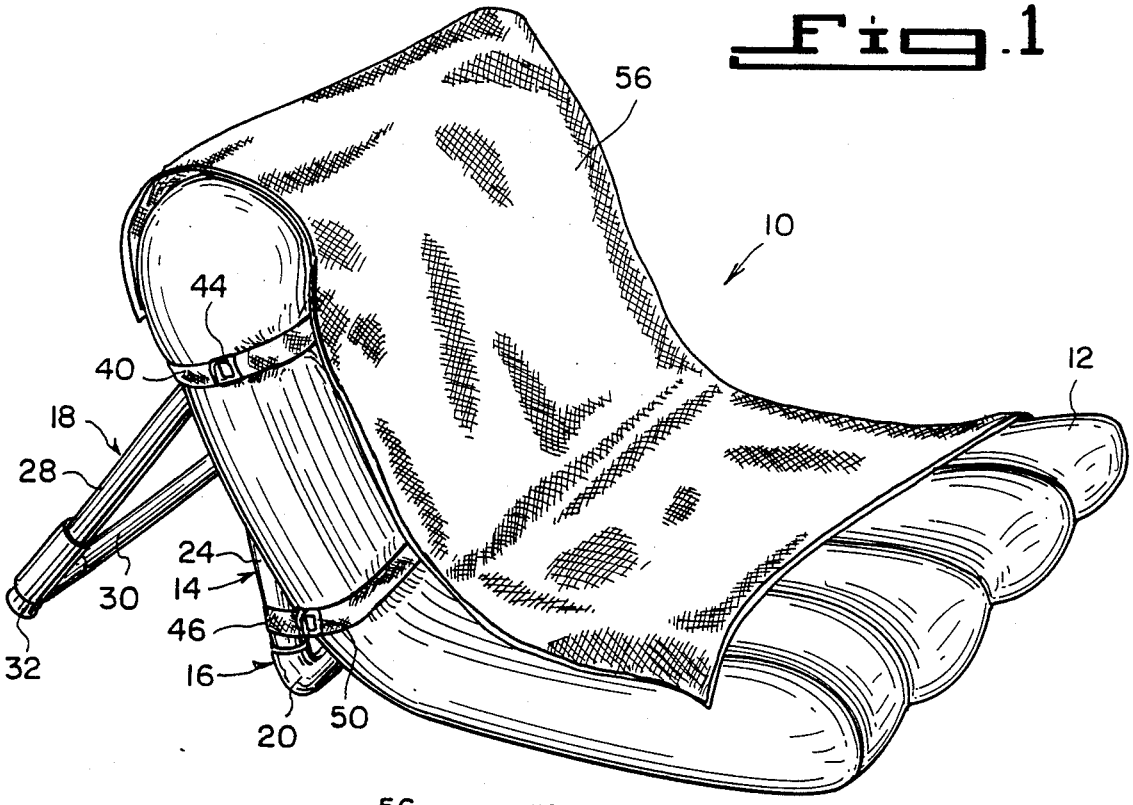
FIG. 1 is a front perspective view of the invention.
Figure 2:
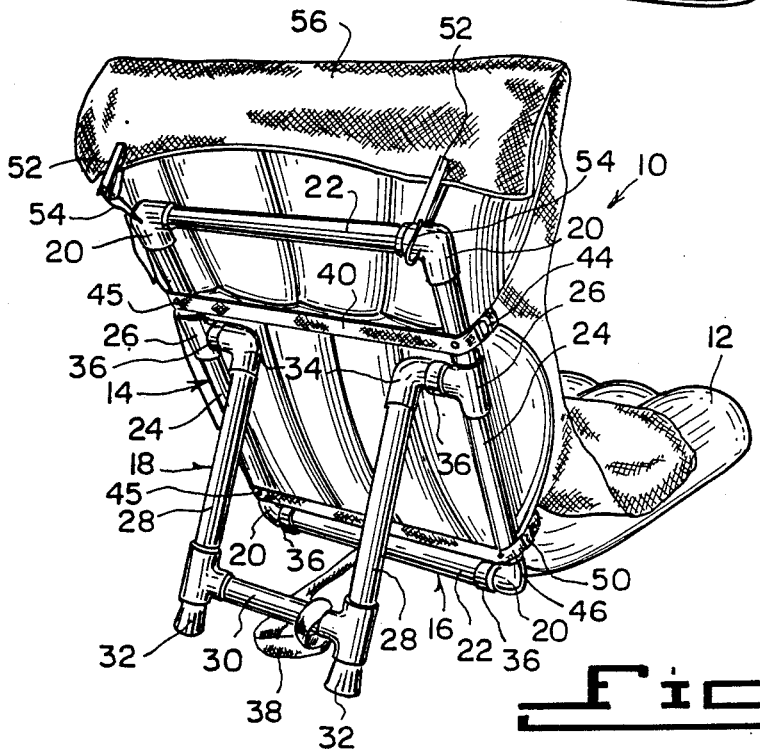
FIG. 2 is a rear perspective view of the invention.
Figure 3:
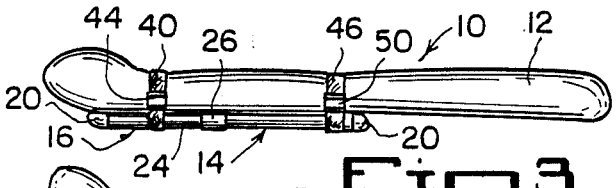
FIG. 3 is a side view showing the backrest frame assembly of the air chair in a flat lay down position.
Figure 4:
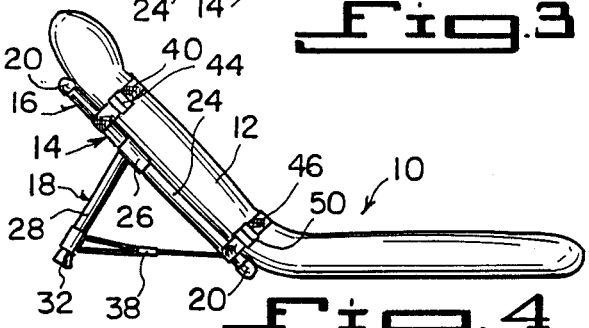
FIG. 4 is a side view similar to FIG. 3, showing the backrest frame assembly of the air chair in an adjusted reclined position.
Figure 5:
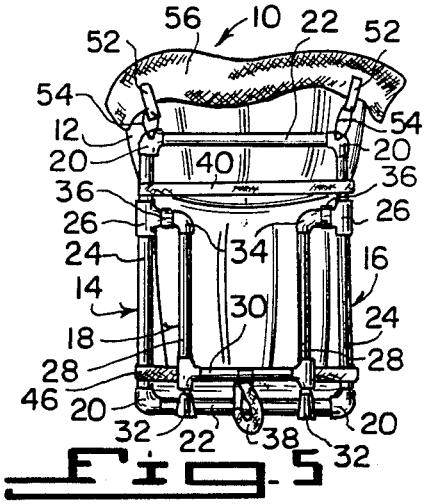
FIG. 5 is a rear view thereof.

Turning now descriptively to the drawings, in which similar reference characters denote similar elements throughout the several views, FIGS. 1 through 7 illustrate an air chair 10 consisting of a rectangular shaped air mattress 12 and an adjustable backrest 14. The air mattress 12 is releasably secured to the adjustable backrest so that the adjustable backrest 14 may be positioned upon beach sand to adjust the air mattress 12 in various reclined positions. A person may sit upon the air mattress 12 and lean comfortably against the portion of the air mattress on the backrest 14.

The adjustable backrest 14 includes a rectangular shaped backrest frame 16 and a back leg assembly 18 adjustably connected to the backrest frame 16. The backrest frame 16 includes four elbow fittings 20 for each corner of the back rest frame, two short pipe members 22 for upper and lower portions of the backrest frame, two long pipe members 24 for side portions of the backrest frame and two tee fittings 26, each attached on one of the long pipe members 24 near the upper short pipe member 22 of the backrest frame 16.

The back leg assembly 18 includes a pair of legs 28, a cross bar 30 extending between the legs 28, a pair of leg tips 32, each attached to bottom of each leg 28 and a pair of threaded nipples 34. Each nipple 34 is attached to top of each leg 28 and one of the tee fittings 26 to allow the legs 28 to pivot together thereupon.

A gasket 36 is positioned between each threaded nipple 34 and each tee fitting 26 to prevent sand and other debris from entering therein. A gasket 36 is also positioned between each lower elbow fitting 20 and the short lower pipe member 22 to prevent the sand and other debris from entering therein. The two lower gaskets 36 are also there to protect the lower elbow fittings 20 and the lower pipe member 22 from getting scratched up when used on a hard surface, such as by a swimming pool or the like.

Figure 6:
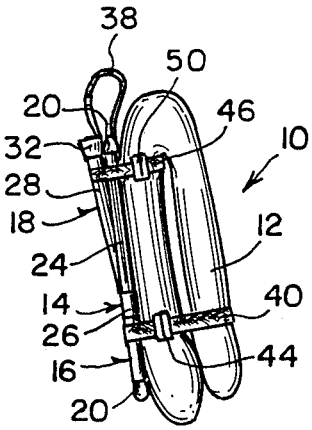
FIG. 6 is a side view showing the air chair in a folded stored position for carrying.
Figure 7:
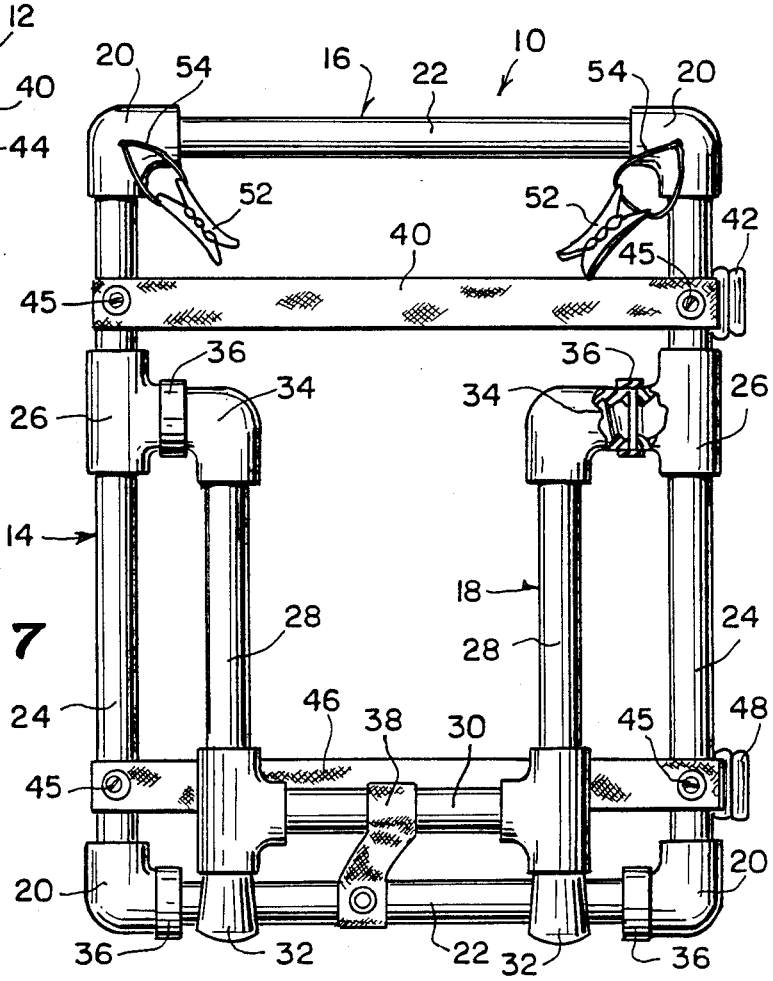
FIG. 7 is an enlarged rear view of just the backrest frame assembly.

An adjustable strap handle 38 extends between the short lower pipe member 22 and the cross bar 30 so that when the air chair 10 is 20 folded up into a stored position the adjustable strap handle 38 can be gripped for easy carrying (see FIG. 6).

A first strap member 40 having an adjustable slide 42 and a buckle 44 is provided. The first strap member 40 is attached across the two long pipe members 24 by fasteners 45 about the tee fittings 26 so that the first strap member 40 can fit around and releasably secure an upper portion of the air mattress 12 to the backrest frame 16. A second strap member 46 having an adjustable slide 48 and a buckle 50 is also provided. The second strap member 46 is attached across the two long pipe members 24 by fasteners 45 near the short lower pipe 22 so that the second strap member 46 can fit around and releasably secure a middle portion of the air mattress 12 to the backrest frame 16.

A clip 52 is secured via a cord 54 to each upper elbow fitting 20 so as to hold a towel 56 in place on the upper portion of the air mattress 12.

The adjustable backrest 14 can be fabricated out of PVC pipes and fittings, while adjustable strap handle 38 and first and second strap members 40 and 46 can all be fabricated out of a polypropaline material. The adjustable slides 42 and 48, buckles 44 and 50 and clips 52 can all be fabricated out of plastic so that the complete air chair 10 is rust proof.

LIST OF REFERENCE NUMBERS 10 air chair
12 air mattress
14 adjustable backrest
16 rectangular shaped backrest frame
18 back leg assembly
20 elbow fitting
22 short pipe member 24 long pipe member
26 tee fitting
28 leg
30 cross bar
32 leg tip
34 threaded nipple
36 gasket
38 adjustable stop handle
40 first strap member
42 adjustable slide in 40
44 buckle in 40
45 fastener
46 second strap member
48 adjustable slide in 46
50 buckle in 46
52 clip
54 cord
56 towel It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An air chair comprising:
a rectangulr shaped air mattress;
an adjustable backrest including
a rectangular shaped backrest frame; and
a back leg assembly adjustably connected to said backrest frame, said backrest frame comprising:
four elbow fittings for each corner of said backrest frame;
two short pipe members for upper and lower portions of said backrest frame;
two long pipe members for said portions of said backrest frame; and
two tee fittings, each attached on one of said long pipe members near said upper short pipe member of said backrest frame, said back leg assembly comprising:
a pair of legs;
a cross bar extending between said legs;
a pair of leg tips, each attached to the bottom of each said leg;
a pair of threaded nipples, each attached to the top of each said leg and one of said tee fittings to allow said legs to pivot together thereupon;
a first set of gaskets, each positioned between one said threaded nipple and said tee fitting to prevent sand and other debris from entering therein; and
a second set of gaskets, each positioned between one said lower elbow fitting and said short lower pipe member to prevent the sand and other debris from entering therein and to also protect said lower elbow fittigs and said lower pipe member from getting scratched up when used on a hard surface, such as by a swimming pool or the like;
and strap means for releasably securing said air mattress to said adjustable backrest so that said adjustable backrest may be positioned upon beach sand to adjust said air mattress in various reclined positions in which a person may sit upon said air mattress and lean comfortably against the portion of said air mattress on said backrest.

2. An air chair as recited in claim 1, further including an adjustable strap handle extending between said short lower pipe member and said cross bar so that when said air chair is folded up into a stored position said adjustable strap handle can be gripped for easy carrying.

3. An air chair as recited in claim 2, wherein said releasably securing means includes:
(a) a first strap member having an adjustable slide and buckle, said first strap member attached across said two long pipe members above said tee fittings to that said first strap member can fit around and releasably secure an upper portion of said air mattress to said backrest frame; and
(b) a second strap member having an adjustable slide and buckle, said second strap member attached across said two long pipe members near said short lower pipe member so that said second strap member can fit around and releasably secure a middle portion of said air mattress to said backrest frame.

4. An air chair as recited in claim 3, further including a pair of clips, each secured to one of said upper elbow fittings so as to hold a towel in place on the upper portion of said air mattress.

5. An air chair comprising:
rectangular shaped air mattress;
an adjustable backrest comprised of a rectangular shaped backrest frame including two generally vertical long tubular members connected at their ends to an upper and lower, generally horizontal, short tubular members; a back leg assembly pivotally connected to said long tubular members of said backrest frame;
and means for releasably securing said air mattress to said adjustable backrest so that said adjustable backrest may be positioned upon beach sand to adjust said air mattress in various reclined positions in which a person may sit upon said air mattress and lean comfortably against the portion of said air mattress on said backrest;
said releasably securing means comprising a first strap member having an adjustable slide and buckle, said first strap member attached across said two long tubular members near the upper short tubular member so that said first strap member can fit around and releasably secure an upper portion of said air mattress to said backrest frame and a second strap member having an adjustable slide and buckle, said second strap member attached across said two long tubular members near the lower short tubular member so that said second strap member can fit around and releasably secure a middle portion of said air mattress to said backrest frame.

* * * * *